US010631583B2

(12) United States Patent
Musciacchio

(10) Patent No.: US 10,631,583 B2
(45) Date of Patent: Apr. 28, 2020

(54) SWIMSUITS

(71) Applicant: Blue Moon S.r.l., Tolentino, Macerata (IT)

(72) Inventor: Giuseppe Musciacchio, Tolentino (IT)

(73) Assignee: Arena Italia S.p.A., Tolentino (IT)

( * ) Notice: Subject to any disclaimer, the term of this patent is extended or adjusted under 35 U.S.C. 154(b) by 0 days.

(21) Appl. No.: 16/437,154

(22) Filed: Jun. 11, 2019

(65) Prior Publication Data

US 2019/0289928 A1 Sep. 26, 2019

Related U.S. Application Data

(63) Continuation of application No. 16/078,644, filed as application No. PCT/IB2016/050939 on Feb. 22, 2016.

(51) Int. Cl.
*A41D 7/00* (2006.01)
*A41D 13/012* (2006.01)

(52) U.S. Cl.
CPC ..... *A41D 7/005* (2013.01); *A41D 7/00* (2013.01); *A41D 13/012* (2013.01); *A41D 2400/24* (2013.01); *A41D 2400/38* (2013.01); *A41D 2600/10* (2013.01)

(58) Field of Classification Search
CPC ..... A41D 7/00; A41D 7/005; A41D 13/012; A41D 2400/24; A41D 2400/38; A41D 2500/20; A41D 2600/10; A41D 1/04; A41D 27/06; A41D 2300/20; A41D 2300/22; A41C 1/08; A63C 2011/046
See application file for complete search history.

(56) References Cited

U.S. PATENT DOCUMENTS 4,475,552 A * 10/1984 Yoshihara ..... A41C 1/06 450/107
4,654,894 A * 4/1987 Kudo ..... A41D 7/00 2/67
4,916,755 A * 4/1990 Feigenbaum ..... A41D 7/00 2/67
5,819,322 A 10/1998 Dicker
5,839,122 A 11/1998 Dicker
6,047,406 A 4/2000 Dicker
(Continued)

FOREIGN PATENT DOCUMENTS

EP 1 563 748 A1 8/2005
EP 2206441 A1 7/2010
(Continued)

*Primary Examiner* — Amy Vanatta
(74) *Attorney, Agent, or Firm* — Blank Rome LLP

(57) ABSTRACT

Swimsuits are provided which include an outer shell made of a flexible stretchable fabric, a thoracic reinforced region arranged in an anterior thoracic region of a trunk portion of the swimsuit and having an anterior-downward converging shape, and an abdominal reinforced region arranged in a lower abdominal and hip region of the trunk portion and having an anterior-upward converging shape, two non-reinforced waist regions arranged in opposite lateral waist regions of the trunk portion and having both a medially converging shape, wherein the thoracic reinforced region, the abdominal reinforced region and the non-reinforced regions border in an X pattern in an anterior region of the trunk portion. Methods of making such swimsuits are also provided.

20 Claims, 5 Drawing Sheets

(56) References Cited

U.S. PATENT DOCUMENTS

| | | | | |
|---|---|---|---|---|
| 8,286,262 | B2 * | 10/2012 | Rance | A41D 7/00 2/67 |
| 8,533,864 | B1 | 9/2013 | Kostrzewski | |
| 9,144,252 | B1 | 9/2015 | Kostrzewski | |
| D841,937 | S * | 3/2019 | Yeomans | A41D 7/00 D2/731 |
| 2001/0014981 | A1 * | 8/2001 | Fairhurst | A41D 7/00 2/69 |
| 2006/0130215 | A1 | 6/2006 | Torry | |
| 2008/0141431 | A1 * | 6/2008 | Rance | A41D 7/00 2/67 |
| 2009/0038047 | A1 | 2/2009 | Di Lorenzo | |
| 2010/0011479 | A1 * | 1/2010 | Onoda | A41D 7/00 2/67 |
| 2010/0077527 | A1 * | 4/2010 | Lee | A41D 13/0015 2/69 |
| 2010/0205713 | A1 | 8/2010 | Takamoto | |
| 2010/0281593 | A1 | 11/2010 | Aloy Font | |
| 2011/0009793 | A1 | 1/2011 | Lucero | |
| 2011/0209267 | A1 | 9/2011 | Rush | |
| 2012/0036614 | A1 | 2/2012 | Meschter et al. | |
| 2012/0100778 | A1 | 4/2012 | Cho | |
| 2012/0255098 | A1 | 10/2012 | Leyva | |
| 2013/0095730 | A1 | 4/2013 | Jensen | |
| 2013/0305425 | A1 | 11/2013 | Zarabi | |
| 2013/0326785 | A1 | 12/2013 | Cornacchiari | |
| 2014/0090142 | A1 * | 4/2014 | Waller | A41D 7/00 2/67 |
| 2014/0096301 | A1 | 4/2014 | Waller | |
| 2015/0201682 | A1 | 7/2015 | Musciacchio | |
| 2016/0129298 | A1 | 5/2016 | Sekula | |
| 2017/0079339 | A1 * | 3/2017 | Yeomans | A41D 7/00 |
| 2017/0172224 | A1 | 6/2017 | Joseph | |

FOREIGN PATENT DOCUMENTS

| | | | |
|---|---|---|---|
| GB | 2481115 | A | 12/2011 |
| WO | WO 2012/164301 | A1 | 12/2012 |
| WO | WO 2014/016643 | A1 | 1/2014 |
| WO | WO 2015/117646 | A1 | 8/2015 |

* cited by examiner

SWIMSUITS

This is a continuation of application Ser. No. 16/078,644, filed Aug. 22, 2018, which is a 371 national stage of PCT/162016/050939, filed Feb. 22, 2016, the entire disclosures of which are herein incorporated by reference.

BACKGROUND OF THE INVENTION

1. Field of the Invention

The present invention relates, in general, to the field of sports garment. More particularly, it relates to swim suits or swim garments for water sports activities and particularly for competition swimming.

2. Description of the Related Art

In the past years, in competitive swimming, very high levels of performance have been achieved thanks to evolved training methods and a specific nutrition which increasingly meet the requirements of the individual physical constitution of the athletes and of the swimming exercise to be performed.

On the other hand, in nearly all fields of sports and particularly in swimming, where the body of the athlete moves across a liquid, the efforts to enhance the performances increasingly focus on the development of sports garment which positively influences both the interaction of the athletes body surface with the environment and the physical conditions of the athlete during the competition or sports exercise and training.

The development of swim suits and garments focuses mainly on two principal goals, i.e. the reduction of friction between the external surface of the swim suit and the water and a hoop-compression of the muscular structure of the athlete in the region of the legs and body trunk. In order to reduce the friction between the swimmer and the water, several stretchable fabrics with an extremely smooth and water repellent external surface texture (e.g. PTFE coated elastic textiles) have been proposed and successfully used.

The hoop-compression of the muscular structure of the swimmer has been aimed to by using swim suits made of stretchable garment material with a comparatively high coefficient of elasticity and by dressing the swimmer with such a small size of swim suit that the consequent stretching of the garment and resulting reaction hoop force result in a radial compression of the swimmer's body trunk and legs. The resulting muscular compression reduces loose muscle totter and prevents the accumulation of lactic acid in the muscles of the swimmer.

An exemplary swim suit made of a stretch fabric which addresses the needs of muscle compression, mechanical durability and wear resistance, as well as long term maintenance of the reversible stretch properties has been e.g. described in WO2014016643A of the same applicant.

Even though the known swimsuits provide generally satisfactory results, they still have some drawbacks. The strong compression applied by the stretch fabric of the swimsuit and the stretch resistance of the stretch fabric itself obstruct or hinder the athlete's torso and legs to flex and move naturally. This is particularly applicable to the torso twist movement necessary for breathing during freestyle swimming, in which the stretch fabric tends to form a cage around the body that prevents the upper torso part from twisting freely with respect to the lower torso part. Such a diffuse and untargeted "cage"—feeling without a purposeful support of specific body parts of the athlete in water, can result in a poor posture and an increased fatigue, particularly towards the end of long distance swim events.

SUMMARY OF THE INVENTION

The object of the present invention is therefore to provide an improved swimsuit which better addresses at least some of the above-described needs.

These and other objects are achieved by swimsuits having the features described and claimed herein.

The dependent claims refer to advantageous embodiments of the invention.

According to an aspect of the invention, a swimsuit, particularly for competition swimming, comprises an outer shell suitable to cover at least part of the body trunk and of the thighs of a swimmer, wherein the outer shell is made of a flexible stretchable fabric adapted to apply a hoop compression to the thighs and to the body trunk, said outer shell forming a tubular trunk portion intended to cover a lower region of the torso of the swimmer and two tubular thigh portions connected with the trunk portion and intended to cover each a region of a respective thigh of the swimmer, wherein the swimsuit forms a thorax-hip-tension line continuously connected to the outer shell and having a greater tensile stiffness (expressed in N/cm) than a tensile stiffness of said outer shell alone, wherein the thorax-hip-tension line comprises two anterior portions extending from opposite lateral thoracic regions diagonally downward across an anterior abdominal region, where they intersect in intersecting point, to opposite lateral hip regions, as well as a rear portion extending all around a rear hip region and adjacent lateral hip regions where it merges with the anterior portions to form an intersecting loop.

Thanks to the crossing and looped thorax-hip-tension line (or stiffening line), during swimming a "pulling"-effect is created that contributes to lift the hip while the swimmer is horizontal in the water. This lifting effect on the hip helps to keep both the hip and the legs high in the water, to maintain a level and even body position and to avoid the legs lowering or dropping which is a major cause of drag in the water. The thus obtained lifting effect is particularly beneficial when the swimmer is fatigued near the end of a long distance event.

According to a further aspect of the invention, a swimsuit, particularly for competition swimming, comprises an outer shell suitable to cover at least part of the body trunk and of the thighs of a swimmer, wherein the outer shell is made of a flexible stretchable fabric adapted to apply a hoop compression to the thighs and to the body trunk, said outer shell forming a tubular trunk portion intended to cover a lower region of the torso of the swimmer and two tubular thigh portions connected with the trunk portion and intended to cover each an upper region of a respective thigh of the swimmer, wherein the swimsuit forms:

- locally reinforced regions in which the outer shell is provided with an additional reinforcement so that the locally reinforced regions have a greater tensile stiffness (expressed in N/cm) than a tensile stiffness of said outer shell alone, and
- non-reinforced regions formed by said outer shell alone and having only the tensile stiffness of said outer shell alone, characterized in that:

- the locally reinforced regions comprise a thoracic reinforced region arranged in an anterior thoracic region of the trunk portion and having an anterior-downward converging or tapered shape, and an abdominal reinforced region arranged in a lower abdominal and anterior hip region of the trunk portion and having an anterior-upward converging or tapered shape, the locally non-reinforced regions comprise two non-reinforced waist regions arranged in opposite lateral (inferior thoracic or abdominal) waist regions of the trunk portion 6 and having both a medially converging or tapered shape, the thoracic reinforced region, the abdominal reinforced region and the non-reinforced waist regions are bordering in an "X" shaped pattern in an anterior region of the trunk portion of the swim suit.

Thanks to the X pattern of reinforced and non-reinforced anterior regions of the swim suit, a medially narrowed abdominal-thoracic joint region between the thoracic reinforced region and the abdominal reinforced region is formed which isolates the upper and lower body movements and allows the upper body to rotate or twist freely while keeping the lower body and core muscles firm and supported. This minimizes additional rotation or loss of optimum body position in water during a freestyle mid-stroke pivot movement for breathing.

Further advantages and features of the present invention are presented in the detailed description below, and are provided as non-limiting examples with reference to the attached drawings.

DETAILED DESCRIPTION OF THE PREFERRED EMBODIMENTS

Figure 1:
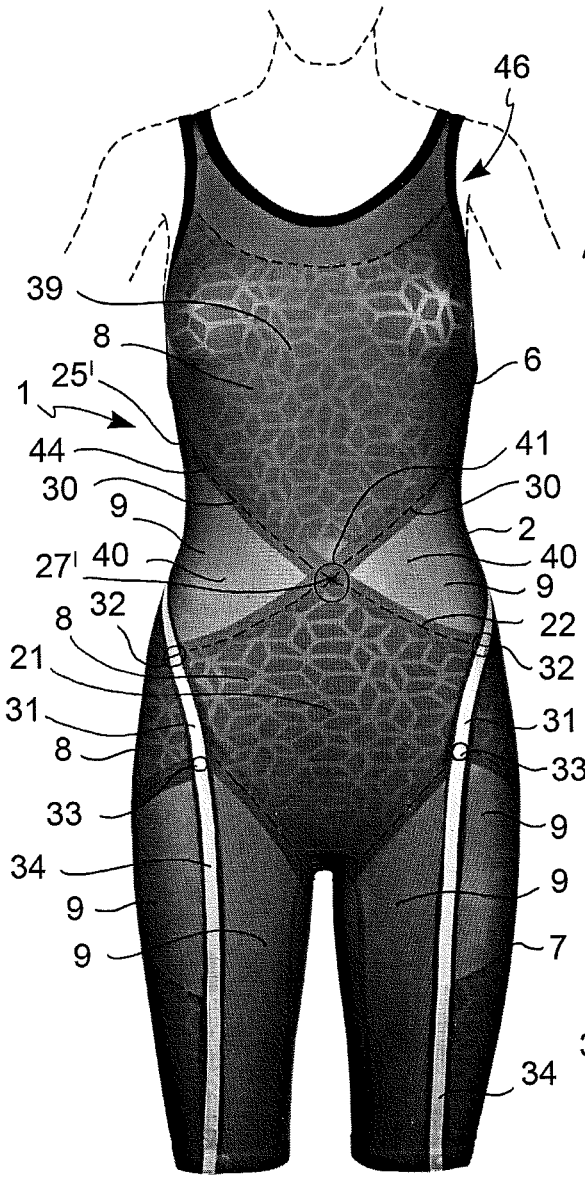
FIG. 1 illustrates a front view of a tank-suit style one-piece female swim suit according to an embodiment of the invention.

With reference to the figures, a swim suit 1, particularly for competition swimming, comprises an outer shell 2 suitable to cover at least part of the body trunk 3 and of the thighs 4 of a swimmer 5, wherein the outer shell 2 is made of a flexible stretchable fabric adapted to apply a hoop compression to the thighs and to the body trunk 3.

More specifically, the outer shell 2 forms a tubular trunk portion 6 intended to cover a lower region of the torso of the swimmer 5 and two tubular thigh portions 7 connected with the trunk portion 6 and intended to cover each an upper region of a respective thigh 4 of the swimmer 5.

In accordance with an aspect of the invention (FIGS. 1, 4, 5), the swimsuit 1 forms a thorax-hip-tension line 44 continuously connected to the outer shell 2 and having a greater tensile stiffness (expressed in N/cm) than a tensile stiffness of said outer shell 2 alone, wherein the thorax-hip-tension line 44 comprises two anterior portions 30, 22 extending from opposite lateral thoracic regions diagonally downward across an anterior abdominal region, where they intersect in intersecting point 27', to opposite lateral hip regions, as well as a rear portion 17 extending all around a rear hip region and adjacent lateral hip regions where it merges with the anterior portions 22 to form an intersecting loop 25'.

Thanks to the crossing and looped thorax-hip-tension line (or stiffening line) 44, during swimming a "pulling"-effect is created that contributes to lift the hip while the swimmer is horizontal in the water. This lifting effect on the hip helps to keep both the hip and the legs high in the water, to maintain a level and even body position and to avoid the legs lowering or dropping which is a major cause of drag in the water. The thus obtained lifting effect is particularly beneficial when the swimmer is fatigued near the end of a long distance event.

In accordance with a further aspect of the invention, the swimsuit forms locally reinforced regions 8 in which the outer shell 2 is provided with an additional reinforcement so that the locally reinforced regions have a greater tensile stiffness (expressed in N/cm) than a tensile stiffness of said outer shell 2 alone, and non-reinforced regions 9 formed by the outer shell 2 alone and having only the tensile stiffness of said outer shell 2 alone.

Figure 6:
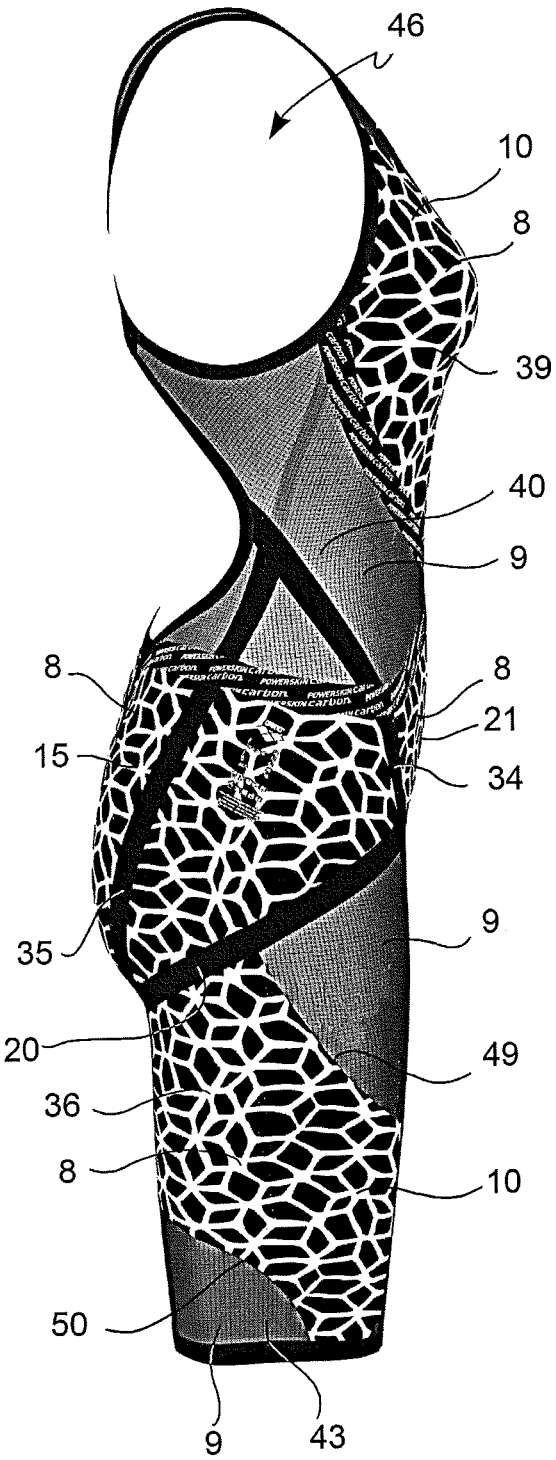
FIG. 6 illustrates a lateral view of the tank-suit style one-piece female swim suit in FIG. 1 everted inside-out.
Figure 3:
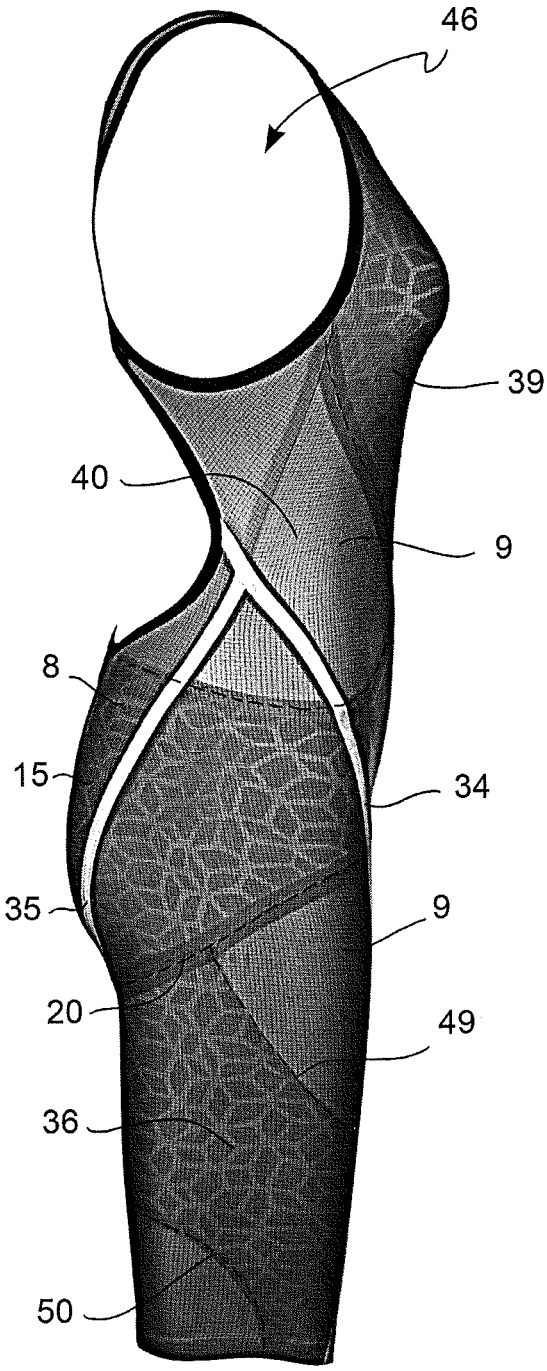
FIG. 3 illustrates a lateral view of the tank-suit style one-piece female swim suit in FIG. 1.
Figure 4:
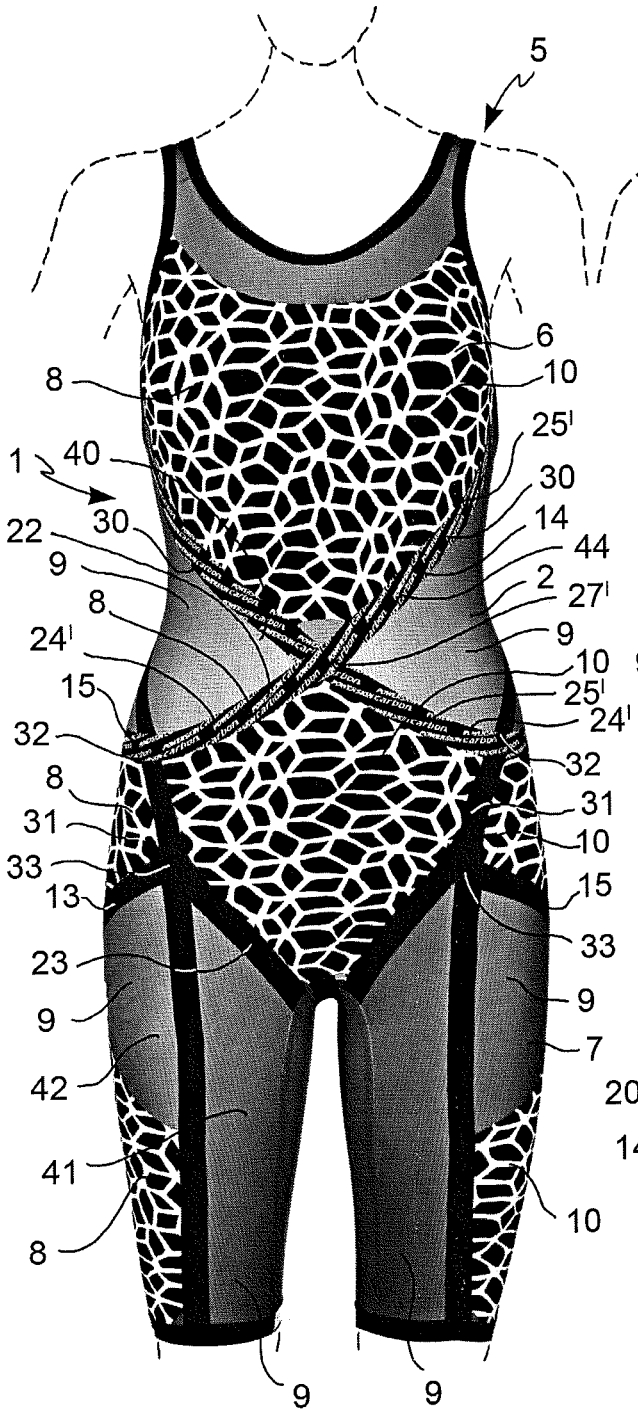
FIG. 4 illustrates a front view of the tank-suit style one-piece female swim suit in FIG. 1 everted inside-out.

In an embodiment (FIGS. 4, 6), the locally reinforced regions 8 comprise a thoracic reinforced region 39 arranged in an anterior thoracic region of the trunk portion 6 and having an anterior-downward converging or tapered shape, and an abdominal reinforced region 21 arranged in a lower abdominal and hip region of the trunk portion 6 and having an anterior-upward converging or tapered shape. The locally non-reinforced regions 9 comprise two opposite non-reinforced waist regions 40 arranged in opposite lateral (inferior thoracic or abdominal) waist regions of the trunk portion 6 and having both a medially converging or tapered shape. The thoracic reinforced region 39, the abdominal reinforced region 21 and the non-reinforced waist regions 40 are bordering in an X pattern in an anterior region of the trunk portion 6 (FIGS. 1, 4).

Thanks to the X pattern of reinforced and non-reinforced anterior regions of the swim suit 1, a medially narrowed abdominal-thoracic joint region 41 between the thoracic reinforced region 39 and the abdominal reinforced region 21 is formed which isolates the upper and lower body movements and allows the upper body to rotate or twist freely while keeping the lower body and core muscles firm and supported. This minimizes additional rotation or loss of optimum body position in water during a freestyle mid-stroke pivot movement for breathing.

Advantageously, the abdominal-thoracic joint region 41 may have a width of less than 10 cm, preferably less then 7 cm or 5 cm or 3 cm, to result sufficiently narrowed to not hinder the above describe movements.

In an embodiment, the abdominal-thoracic joint region 41 can be embodied by the crossing anterior portions 30, 22 of the thorax-hip-tension line 44, or more generally by crossing connecting lines 14 that will be described below.

In accordance with a further aspect of the invention, in the locally reinforced regions 8 an additional inner layer 10 of a flexible stretchable fabric is attached from inside to the outer shell 2. The stretchable fabric of the outer shell 2 and the stretchable fabric of the only locally applied inner layer 10 include both woven-in carbon fiber reinforcement, and the stretchable fabric of the outer shell has bi-directionally woven-in carbon fiber reinforcement and anisotropic stretch properties.

Thanks to the combination of non-reinforced outer shell 2—only regions 9 and only locally arranged reinforced double-layer regions 8, in which both layers are fiber reinforced and the outer shell layer 2 has a bi-directional fiber reinforcement and anisotropic stretch properties, the swim suit 1 reconciles the contrasting needs of a possibly uniform and intense hoop compression of the athlete's muscles, a generally unrestricted freedom of movement and longitudinal reach of the arm strokes, a possibly accurate conformity with the athlete's body shape and pressure distribution in order to streamline the athlete's body shape, as well as selective additional support of key muscle groups, such as e.g. pectoral muscles, abdominal muscles, lateral thigh muscles or gluteus maximus.

In accordance with an embodiment, the bidirectional carbon fiber reinforcement of the outer shell 2 fabric comprises a first group of hoop direction (or, with the athlete standing upright, horizontally) oriented carbon fiber threads 11 and a second group of longitudinally (or, with the athlete standing upright, vertically) oriented carbon fiber threads 12.

The hoop oriented carbon fiber threads 11 extend generally parallel to each other at a distance of between 1.5 and 2.5 mm, preferably about 2 mm, and the longitudinal carbon fiber threads 12 extend generally parallel to each other at a distance of between 1.5 and 2.5 mm, preferably about 2 mm, and perpendicularly to the hoop oriented carbon fiber threads 11. In a preferred embodiment, the hoop oriented carbon fiber threads 11 and the longitudinal carbon fiber threads woven in the outer shell 2 fabric 12 define a 2 mm×2 mm squared regular pattern.

The total uniformly distributed hoop carbon fiber content of the first group (expressed in terms of carbon fiber mass [g] per area [$cm^2$] of the non-stretched outer shell 2 fabric) equals the total uniformly distributed longitudinal carbon fiber content of the second group (expressed in terms of carbon fiber mass [g] per area [$cm^2$] of the non-stretched outer shell 2 fabric).

In a preferred embodiment, the total carbon fiber content, in terms of % by weight, of the outer shell 2 is in the range of 2.3% to 3.7%, preferably from 2.7% to 3.3%, more preferably about 3%.

The outer shell 2 fabric is configured such that its elastic extensibility (expressed in terms of %) in the longitudinal direction is greater than its elastic extensibility (expressed in terms of %) in the hoop direction. In an embodiment, the elastic extensibility of the outer shell 2 fabric in the longitudinal direction ranges from 85% to 115%, preferably from 95% to 105%, more preferably about 100%, whereas the elastic extensibility of the outer shell 2 fabric in the hoop direction ranges from 65% to 85%, preferably from 70% to 80%, more preferably about 75%.

This directional anisotropic stretch property of the outer shell 2 fabric combines general uniform hoop compression of the muscles with freedom of longitudinal movement and arm stroke with the stretched fabric being closer to the hoop strain limit than to the longitudinal strain limit.

In accordance with an embodiment, the carbon fiber reinforcement of the inner layer 10 fabric is substantially unidirectional in the hoop direction (or, with the athlete standing upright, horizontally) only. The hoop oriented carbon fiber threads of the inner layer 10 fabric extend generally parallel to each other at a distance of between 8 and 10 mm, preferably about 9 mm, and there are no longitudinal carbon fiber threads in the inner layer 10 fabric.

In a preferred embodiment, the total carbon fiber content of the inner layer 10, in terms of % by weight, is in the range of 0.5% to 1.5%, preferably about 1%.

The locally arranged inner layer 10 comprises one or more individual inner layer 10 pieces that are connected, e.g. bonded, to the outer shell 2 along discrete or continuous connection lines 14, preferably along peripheral edges 13 of the inner layer 10 piece, and preferably without being connected over the entire surface of the inner layer 10 pieces.

This allows for differential bi-dimensional strain of the inner layer 10 and the outer shell 2, so that the outer shell can maintain uniform compression while the inner layer 10 can provide focused support of key muscle groups in dependency of the current body posture and without being constrained by the outer shell 2 over the entire surface area of the inner layer 10 piece. The connection lines 14 can be embodied by adhesive gluing and/or by means of a connection or bonding tape 15 or stripe extending along the connection lines 14 where it connects the outer shell 2 and the inner layer 10 together. Both the adhesive or the bonding tape 15 may have thermosetting properties and can be applied to the outer shell 2 fabric and to the inner layer 10 fabric by means of heating and pressure.

In accordance with embodiments, the locally reinforced regions 8 comprise a locally reinforced gluteus maximus region 15 covering an area of the gluteus maximus. The locally reinforced gluteus maximus region 15 comprises a gluteus maximus inner layer 10 piece shaped and arranged to cover the area of the gluteus maximus and possibly substantially limited to only said area, as well as:

- a posterior superior connecting line 17 extending transversally from one lateral side to the opposite lateral side in a superior end region of the gluteus maximus muscle of the wearer,
- a posterior medial connecting line 16 extending from the lumbar vertebrae region medially downward into the crotch region,
- two posterior inferior connecting lines 20 extending from the crotch region rearward, laterally outward and upward (along an inferior end region of the gluteus maximus muscle of the wearer).

Advantageously, an upper end section of the posterior medial connecting line 16 crosses or overlaps with a medial portion 18 of the posterior superior connecting line 17 (in the lower lumbar vertebrae region or upper sacrum region), e.g. by means of crossing superimposed bonding tape or by means of folded fabric crossing with superimposed bonding tape, such that both connecting lines are anchored to each other.

Similarly, a lower end section of the posterior medial connecting line 16 connects, e.g. crosses or overlaps, in the crotch region with lower end sections of the two posterior inferior connecting lines 20, e.g. by means of crossing superimposed bonding tape or by means of folded fabric crossing with superimposed bonding tape, such that these three connecting lines 16, 20 are anchored to each other.

Similarly, laterally most outer sections of the two posterior inferior connecting lines 20 cross or overlap with two opposite laterally most outer sections of the posterior superior connection line 17 (FIG. 12), e.g. by means of crossing superimposed bonding tape, such that these connecting lines 17, 20 are anchored to each other.

Alternatively (FIGS. 4, 5, 6), the two posterior inferior connecting lines 20 may not cross or overlap with the posterior superior connection line 17.

In accordance with an embodiment (FIGS. 7 to 12), particularly in a male jammer type swim suit, the posterior superior connecting line 17 is substantially arch shaped with a flattened (nearly straight horizontal) medial portion 18 and two opposite lateral portions 19 that extend progressively outward and downward towards the superior thigh muscle region.

Expressed in terms of a skeleton anatomy reference system, the posterior superior connecting line 17 extends advantageously across the lower lumbar vertebral region, close to the region where the lumbar vertebrae connect to the sacrum, and having the above said two opposite lateral portions 19 that extend progressively outward and downward.

The connecting lines 16, 17, 18, 19, 20 connect the inner layer 10 of the gluteus maximus reinforcement region 15 to the outer shell 2.

In accordance with embodiments, the locally reinforced regions 8 comprise a locally reinforced abdominal region 21 covering an area of at least the lower abdomen. The locally reinforced abdominal region 21 comprises an abdominal inner layer 10 piece shaped and arranged to cover the area of the lower abdominal muscles of the wearer and possibly substantially limited to only the abdominal or lower abdominal area, as well as:

- an anterior superior connecting line 22 extending transversally from one lateral side to the opposite lateral side across the abdominal muscle region,
- two anterior inferior connecting lines 23 extending from the crotch region forward, laterally outward and upward (along a separation region between the abdominal muscles and the thigh muscles of the wearer).

The anterior inferior connecting lines 23 may connect to a lower end section of the posterior medial connecting line 16 and with lower end sections of the two posterior inferior connecting lines 20 in the crotch region e.g. by means of crossing superimposed bonding tape and/or by means of folded fabric crossing with superimposed bonding tape, such that these connecting lines 23, 16, 20 are anchored to each other.

In an embodiment (FIG. 10), laterally most outer sections of the two anterior inferior connecting lines 23 cross or overlap with two lateral sections of the anterior superior connection line 22, e.g. by means of crossing superimposed bonding tape or by means of folded fabric crossing with superimposed bonding tape, such that these connecting lines 23, 22 are anchored to each other.

Alternatively (FIGS. 4, 6), the two anterior inferior connecting lines 23 may not cross or overlap with the anterior superior connection line 22.

In accordance with an embodiment (FIGS. 10 to 12), particularly in a male jammer type swim suit, the anterior superior connecting line 22 is substantially continuously flat arch shaped with two opposite lateral portions 24 that extend progressively outward and which can preferably continuously merge with and, hence, continue as the lateral end portions of the posterior inferior connecting lines 20 in a manner that the posterior inferior connecting lines 20 and the anterior superior connecting line 22 form a substantially closed loop 25 or a substantially closed semi-loop 25 of a "folded 8" shaped connection line having a further closed semi-loop 26 extending all around the waist of the wearer and a connection line crossing point 27 between the semi-loops 25, 26 at a central region or apex of the anterior superior connecting line 22.

In an embodiment (FIGS. 9, 12), the locally reinforced regions 8 may comprise two reinforced opposite lateral transition regions 28 positioned between the lateral ends of the gluteus maximus region 15 and the adjacent lateral ends of the abdominal region 21 and delimited by the posterior superior connecting line 17 and the anterior superior connecting line 22 (from below) and, possibly, by the further closed semi-loop 26 (from above).

In accordance with an embodiment (FIGS. 4, 5, 6), particularly in a tank-suit style one-piece female swim suit, the anterior superior connecting line 22 forms a medial upwardly oriented cusp from which two opposite lateral portions 24' extend laterally outward while converging from above towards a horizontal hoop direction. The two opposite lateral portions 24' can preferably continuously merge with and, hence, continue as the lateral end portions of the posterior superior connecting line 17 in a manner that the posterior superior connecting line 17 and the anterior superior connecting line 22 form a substantially closed loop 29 or a substantially closed semi-loop 29 extending all around the hip of the wearer, of an intersecting "α" or "∞" loop shaped connection line having a further open (e.g. "V" shape) or closed ("O" shaped) loop portion 30 and a connection line crossing point 27' between the semi-loop 29, and the loop portion 30 at the cusp apex of the anterior superior connecting line 22.

The reinforced gluteus maximus region 15 and the reinforced abdominal region 21 can be directly bordering and connected to each other and to the outer shell 2, along two downwardly extending connecting lines 31 each of which crosses or overlaps with the loop 26 or, in other words, with a lateral outer portion of the anterior superior connecting line 22 and/or an adjacent lateral outer portion of the posterior superior connecting line 17 such as to form upper anterior hip anchor points 32. The downwardly extending connecting lines 31 also cross or overlap with lateral outer portions of the anterior inferior connecting lines 23 and/or with adjacent opposite lateral outer portions of the posterior inferior connecting lines 20 such as to form lower anterior hip anchor points 33.

The downwardly extending connecting lines 31 may advantageously form a section of two continuous anterior stiffening lines 34 extending substantially parallel to a thigh longitudinal axis over the anterior thigh region of each leg portion of the swim suit 1. The anterior stiffening lines 34 may further extend over an anterior lower waist region upward and up into a lateral upper waist region of the swim suit 1.

Figure 12:
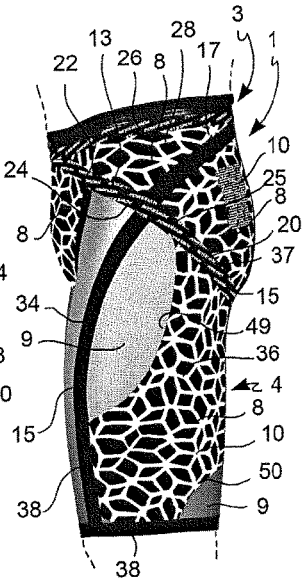
FIG. 12 illustrates a lateral view of the jammer style male swim suit in FIG. 7, inside-out.

In an alternative embodiment (FIGS. 7 to 12), the swim suit 1 forms two continuous anterior stiffening lines 34 which extend substantially parallel to a thigh longitudinal axis over the anterior or anterior-lateral thigh region of each leg portion of the swim suit 1, and the anterior stiffening lines 34 may connect to or merge into lateral outer ends of the posterior superior connecting line 17 such as to form one continuous line therewith (FIG. 12).

Figure 2:
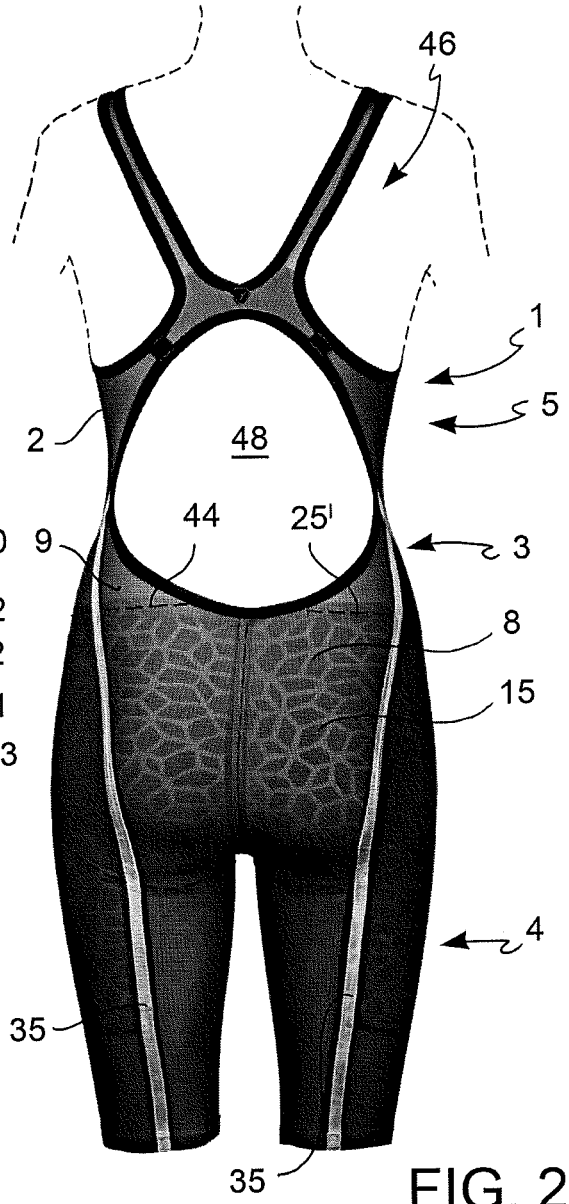
FIG. 2 illustrates a rear view of the tank-suit style one-piece female swim suit in FIG. 1.
Figure 1A:
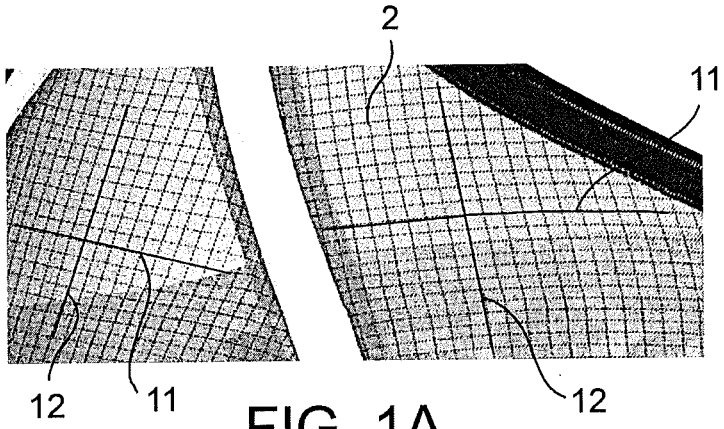
FIG. 1A shows an enlarged detail of a swim suit according to an embodiment of the invention.

The swim suit 1 may further form two posterior stiffening lines 35 extending substantially parallel to a thigh longitudinal axis centrally over the rear thigh region of each leg portion of the swim suit 1 and further upward across the gluteus maximus region 15. In an embodiment (e.g. FIG. 2, 5) the posterior stiffening lines 35 may further extend upward from the gluteus maximus region 15 up into a lateral upper waist region of the swim suit 1.

In an alternative embodiment (FIG. 11), the two posterior stiffening lines 35 may terminate at and be connected to the posterior superior connecting line 17.

In an embodiment (FIGS. 3, 6, 9, 12), the locally reinforced regions 8 may comprise two lateral thigh reinforced regions 36 arranged at a lateral outer thigh region of the wearer and extending diagonally from a superior rear lateral thigh region downward and forward to a lower anterior lateral thigh region.

Advantageously, an upper posterior edge 37 and a lower anterior edge 38 of the inner layer 10 pieces of the lateral thigh reinforced regions 36 are connected to the outer shell 2 by connecting lines, whereas a free upper anterior edge 49 and a free lower posterior edge 50 of the inner layer 10 pieces of the lateral thigh reinforced regions 36 are not connected to the outer shell 2. This particular configuration combines selective muscle compression of the lateral outer thigh muscle group with freedom of movement of the swimmers legs.

In a preferred embodiment, the upper posterior edge 37 and the lower anterior edge 38 are connected to the outer shell by the posterior inferior connecting line 20 and by the anterior stiffening line 34, respectively.

Moreover, the free upper anterior edge 49 and a free lower posterior edge 50 are concavely curved, thereby providing additional freedom to move to the superior anterior thigh muscles and to the inferior posterior thigh muscles.

Also in the thoracic reinforced region 39 the inner layer 10 piece is connected to the outer shell 2 along (preferably only) peripheral edges thereof. A superior edge of the inner layer 10 piece of the thoracic reinforced region 39 may be advantageously a free edge that is not connected to the outer shell 2. This would provide additional longitudinal freedom of movement particularly for forward arm strokes.

In a further embodiment (FIGS. 4, 5, 10, 11), the locally non-reinforced regions 9 comprise one or more of:

two opposite inner thigh non-reinforced regions 41, two superior anterior thigh non-reinforced regions 42, two inferior posterior thigh non-reinforced regions 43.

The inner thigh non-reinforced regions 41 are directly adjacent to and bordering with the gluteus maximus reinforced region 15, the abdominal reinforced region 21 and the lateral thigh reinforced region 36.

The superior anterior thigh non-reinforced regions 42 are directly adjacent to and bordering with the lateral thigh reinforced region 36 and with at least one of the gluteus maximus reinforced region 15 and the abdominal reinforced region 21.

The inferior posterior thigh non-reinforced regions 43 are directly adjacent to and bordering with the lateral thigh reinforced region 36.

In each tubular thigh portion 7 of the swim suit 1, the inner thigh non-reinforced region 41, the superior anterior thigh non-reinforced region 42 and the inferior posterior thigh non-reinforced region 43 may form together an uninterrupted thigh non-reinforced region, with the only exception of the possibly provided discrete anterior stiffening line 34 and posterior stiffening line 35.

In the present description, the tensile stiffness of the tension lines or stiffening lines is intended as reaction force per unit width of fabric perpendicular to the direction of a given applied tensile strain, i.e. in the direction of the tension/stiffening lines.

In accordance with an embodiment, the described tension/stiffening lines 34, 35, 44 comprise a stripe of overlapped and bonded (e.g. glued), multiple layer (e.g. double layer) outer shell 2 fabric. Additionally or alternatively the described tension/stiffening lines 34, 35, 44 may comprise tape fastened externally or internally to the outer shell 2 fabric.

In this way a seam is created along the stiffening lines 34, 35, 44 that has a significantly greater stretch resistance (or in other words significantly greater Young's modulus) than the outer shell 2 fabric panels which it joins and/or to which it is applied.

Advantageously, the glue and/or the tape may have thermosetting properties and can be applied to the outer shell 2 fabric by means of heating and pressure.

In accordance with an embodiment of a male jammer type swimsuit (FIGS. 7-12), the trunk portion 6 has an upper opening (trunk opening) 45 in the region of the waist of the wearer, provided with an annular waistband which may have a drawstring and which is lined or coated with rubber elastic material or elastomeric material, e.g. silicone, facing inside the swimsuit 1 to ensure its adherence and attachment to the skin.

In accordance with an embodiment of a tank-suit style one-piece female swim suit (FIGS. 1-6), the trunk portion 6 forms two upper arm/shoulder openings 46 in a shoulder region of a wearer. An annular shoulder band 47, such as a binding tape or a stripe made from or coated with rubber elastic material or elastomeric material, e.g. silicone, is connected (e.g. bonded by gluing or heat sealing) with the arm/shoulder openings 46 and extends at least in a region under the arm and possibly all around the arm opening 46, e.g. from above the shoulders frontally downward under the arm and from there backward and upward along the shoulder blade region, as shown in FIGS. 1 to 6.

Advantageously, the annular shoulder bands 47 are arranged to cover an outer shell 2 edge at arm openings 46.

Figure 5:
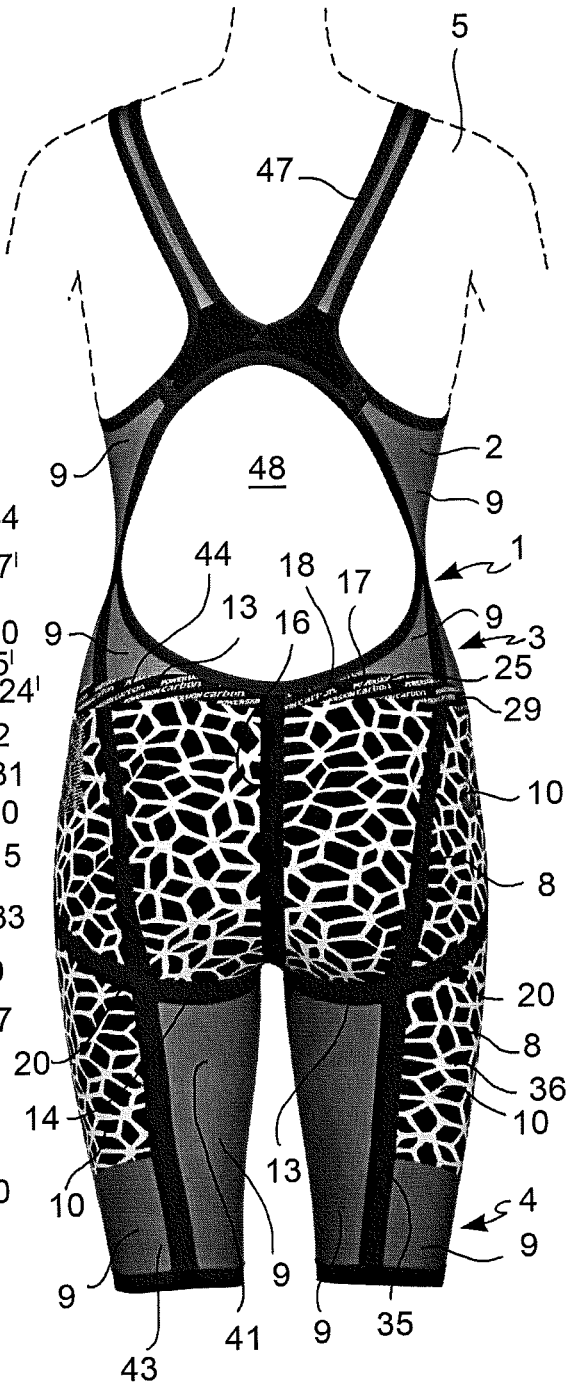
FIG. 5 illustrates a rear view of the tank-suit style one-piece female swim suit in FIG. 1 everted inside-out.
Figure 7:
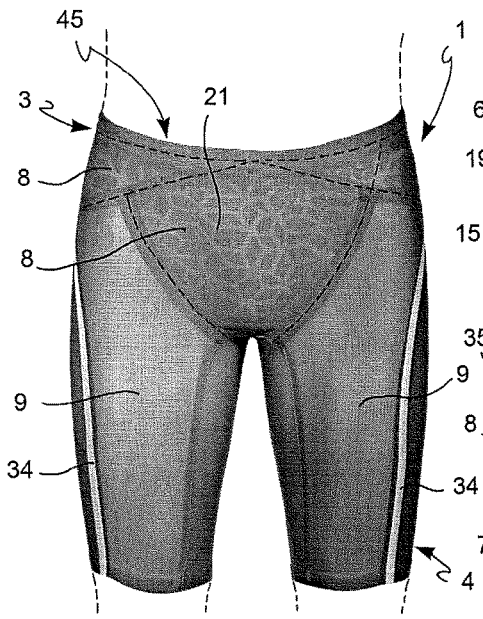
FIG. 7 illustrates a front view of a jammer style male swim suit according to an embodiment of the invention.
Figure 8:
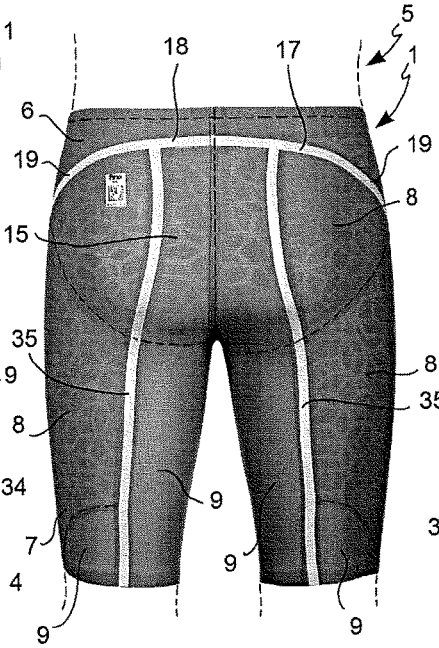
FIG. 8 illustrates a rear view of the jammer style male swim suit in FIG. 7.
Figure 9:
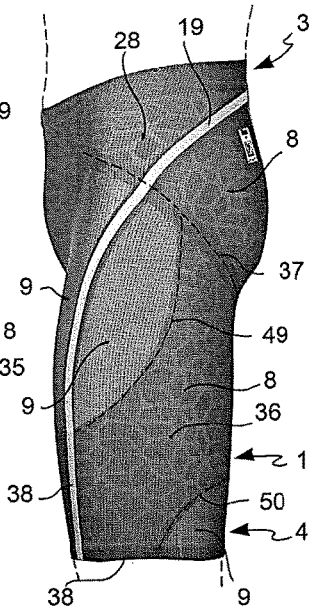
FIG. 9 illustrates a lateral view of the jammer style male swim suit in FIG. 7.
Figure 10:
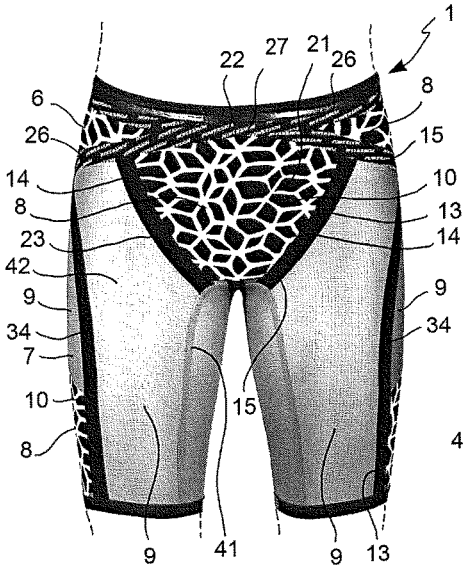
FIG. 10 illustrates a front view of the jammer style male swim suit in FIG. 7, inside-out.
Figure 11:
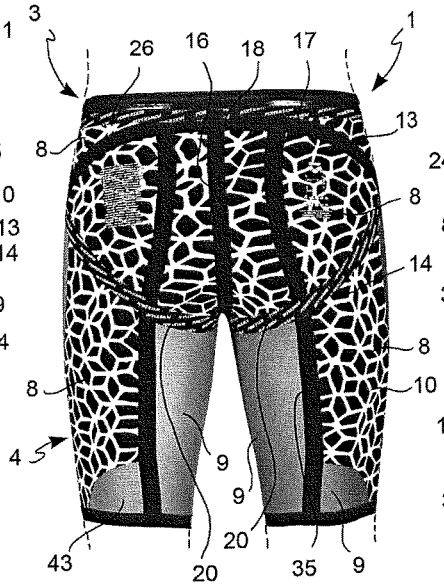
FIG. 11 illustrates a rear view of the jammer style male swim suit in FIG. 7, inside-out.

The swim suit 1 may form a back opening 48 (FIG. 5). Upper ends of the anterior and/or posterior stiffening lines 34, 35 may be arranged at and connected to the respective shoulder bands 47 which may act as upper anchor points for the stiffening lines 34, 35.

The described stiffening lines 34, 35 even though significantly less stretchable in their longitudinal direction than the outer shell 2 fabric, are still flexible, i.e. bendable, so they adapt to the shape of the body and move together with the body movements.

In an exemplary non-limiting embodiment, the outer shell 2 fabric may contain:

polyamide in a range of 44% to 57%, preferably about 50% by weight, and

Elastane® in a range of 40% to 53%, preferably about 47% by weight, and carbon fibers in a range of 2.2% to 3.5%, preferably about 3% by weight.

the inner layer 10 fabric may contain:

polyamide in a range of 57% to 72%, preferably about 65% by weight, and

Elastane® in a range of 27% to 41%, preferably about 34% by weight, and carbon fibers in a range of 0.7% to 1.5%, preferably about 1% by weight.

The tapes placed along the stiffening lines and/or the connecting lines may contain:

polyamide in a range of 60% to 70%, preferably about 65% by weight, and

Elastane® in a range of 29% to 39%, preferably about 35% by weight, and

Within the description and claims, the anatomical reference directions anterior, posterior, superior, inferior, lateral, medial are referred not to a person wearing the swim suit but only to the swim suit positioned as if it were worn by a person in an upright posture.

Similarly, the reference to the position of anatomical structures, such as muscle groups, are referred not to a person wearing the swim suit but only to the swim suit positioned as if it were worn by a person in an upright posture. Instead of artificially defining non-intuitive geometrical references, the anatomical reference system has been adopted here for the sake of a clearer understanding of the invention and definition of its scope.

The overall principle of the invention remaining the same, details of construction and embodiments may be varied with respect to those described, which have been given purely by way of example, without thereby departing from the scope of the invention as described and claimed herein. Additional advantages and modifications may readily appear to persons skilled in the art based on the teachings provided herein.

The invention claimed is:

1. A swim suit for competition swimming, comprising:

an outer shell suitable to cover at least part of the body trunk and of the thighs of a swimmer, wherein the outer shell is made of a flexible stretchable fabric adapted to apply a hoop compression to the thighs and to the body trunk, wherein the outer shell forms a tubular trunk portion intended to cover a lower region of the torso of the swimmer and two tubular thigh portions connected with the trunk portion and intended to cover each an upper region of a respective thigh of the swimmer, wherein the swimsuit forms locally reinforced regions in which the outer shell is provided with an additional reinforcement so that the locally reinforced regions have a greater tensile stiffness than a tensile stiffness of said outer shell alone, and non-reinforced regions formed by the outer shell alone and having only the tensile stiffness of said outer shell alone, wherein the locally reinforced regions comprise a thoracic reinforced region arranged in an anterior thoracic region of the trunk portion and having an anterior-downward converging or tapered shape, and an abdominal reinforced region arranged in a lower abdominal and hip region of the trunk portion and having an anterior-upward converging or tapered shape, wherein the locally non-reinforced regions comprise two opposite non-reinforced waist regions arranged in opposite lateral waist regions of the trunk portion, both having a medially converging or tapered shape, the thoracic reinforced region, the abdominal reinforced region and the non-reinforced waist regions bordering in an X pattern in an anterior region of the trunk portion, wherein the swimsuit forms a thorax-hip-tension line continuously connected to the outer shell and having a greater tensile stiffness than a tensile stiffness of said outer shell alone, the thorax-hip-tension line comprising two anterior portions extending from opposite lateral thoracic regions diagonally downward across an anterior abdominal region, where they intersect in an intersecting point, to opposite lateral hip regions, wherein, in the locally reinforced regions, an additional inner layer of a flexible stretchable fabric is attached from inside to the outer shell, and wherein the inner layer comprises one or more individual inner layer pieces that are connected to the outer shell not over the entire surface of the inner layer pieces, but along connection lines extending along peripheral edges of the inner layer piece.

2. A swim suit according to claim 1, wherein the locally reinforced regions comprise a locally reinforced gluteus maximus region configured to cover an area of the gluteus maximus, said locally reinforced gluteus maximus region comprising a gluteus maximus inner layer piece shaped and arranged to cover the area of the gluteus maximus, as well as:

a posterior superior connecting line configured to extend transversally from one lateral side to the opposite lateral side in a superior end region of the gluteus maximus muscle of the swimmer, a posterior medial connecting line configured to extend from the lumbar vertebrae region medially downward into a crotch region of the swimmer, and two posterior inferior connecting lines configured to extend from the crotch region rearward, laterally outward and upward along an inferior end region of the gluteus maximus muscle of the swimmer, wherein said connecting lines connect the inner layer of the gluteus maximus reinforcement region to the outer shell.

3. A swim suit according to claim 1, wherein the connection lines are embodied by adhesive gluing and by means of a bonding tape extending along the connection lines, where the bonding tape connects the outer shell and the inner layer together, wherein the bonding tape has thermosetting properties and is applied to the outer shell fabric and to the inner layer fabric by means of heating and pressure.

4. A swim suit according to claim 2, wherein an upper end section of the posterior medial connecting line crosses or overlaps with a medial portion of the posterior superior connecting line by means of crossing superimposed bonding tape such that both connecting lines are anchored to each other.

5. A swim suit according to claim 2, wherein a lower end section of the posterior medial connecting line connects in the crotch region with lower end sections of the two posterior inferior connecting lines, such that these three connecting lines are anchored to each other.

6. A swim suit according to claim 2, wherein the swim suit further forms two posterior stiffening lines extending parallel to a thigh longitudinal axis centrally over the rear thigh region of each leg portion of the swim suit and further upward across the gluteus maximus region.

7. A swim suit according to claim 1, wherein the locally reinforced regions comprise two lateral thigh reinforced regions arranged to cover a lateral outer thigh region of the swimmer and extending diagonally from a superior rear lateral thigh region downward and forward to a lower anterior lateral thigh region.

8. A swim suit according to claim 1, wherein the thorax-hip-tension line comprises a rear portion extending all around a rear hip region and adjacent lateral hip regions.

9. A swim suit according to claim 1, wherein, by means of the X pattern of reinforced and non-reinforced anterior regions of the swim suit, a medially narrowed abdominal-thoracic joint region between the thoracic reinforced region and the abdominal reinforced region is formed which has a width of less than 5 cm.

10. A swim suit according to claim 9, wherein the abdominal-thoracic joint region is embodied by the intersecting anterior portions of the thorax-hip-tension line.

11. A swim suit according to claim 2, wherein the two posterior inferior connecting lines do not cross or overlap with the posterior superior connection line.

12. A swim suit according to claim 1, wherein the locally reinforced regions comprise a locally reinforced abdominal region configured to cover an area of at least the lower abdomen, said locally reinforced abdominal region comprising an abdominal inner layer piece shaped and arranged to cover the area of the lower abdominal muscles of the swimmer, as well as:

an anterior superior connecting line configured to extend transversally from one lateral side to the opposite lateral side across an abdominal muscle region, two anterior inferior connecting lines extending from a crotch region forward, laterally outward and upward.

13. A swim suit according to claim 2, wherein the locally reinforced regions comprise a reinforced abdominal region configured to cover an area of at least the lower abdomen, said reinforced abdominal region comprising an anterior superior connecting line configured to extend transversally from one lateral side to the opposite lateral side across an abdominal muscle region, and wherein the reinforced gluteus maximus region and the reinforced abdominal region are directly bordering and connected to each other and to the outer shell along two downwardly extending connecting lines, each of which crosses or overlaps with a lateral outer portion of the anterior superior connecting line such as to form upper anterior hip anchor points.

14. A swim suit according to claim 13, wherein the downwardly extending connecting lines also cross or overlap with lateral outer portions of anterior inferior connecting lines and with adjacent opposite lateral outer portions of the posterior inferior connecting lines so as to form lower anterior hip anchor points.

15. A swim suit according to claim 13, wherein the downwardly extending connecting lines form a section of two continuous anterior stiffening lines extending substantially parallel to a thigh longitudinal axis over an anterior thigh region of each leg portion of the swim suit, and wherein the anterior stiffening lines further extend over an anterior lower waist region upward and up into a lateral upper waist region of the swim suit.

16. A swim suit according to claim 6, wherein the posterior stiffening lines further extend upward from the gluteus maximus region up into a lateral upper waist region of the swim suit.

17. A swim suit according to claim 1, wherein, in the thoracic reinforced region, the inner layer piece is connected to the outer shell along peripheral edges of the inner layer piece.

18. A swim suit according to claim 2, wherein the locally non-reinforced regions comprise:

two opposite inner thigh non-reinforced regions, and two superior anterior thigh non-reinforced regions, wherein the inner thigh non-reinforced regions are directly adjacent to and bordering with the gluteus maximus reinforced region, the abdominal reinforced region and a lateral thigh reinforced region, and wherein the superior anterior thigh non-reinforced regions are directly adjacent to and bordering with the lateral thigh reinforced region and with at least one of the gluteus maximus reinforced region and the abdominal reinforced region.

19. A swim suit according to claim 18, wherein:

the locally non-reinforced regions further comprise two inferior posterior thigh non-reinforced regions, the inferior posterior thigh non-reinforced regions are directly adjacent to and bordering with the lateral thigh reinforced region, in each tubular thigh portion of the swim suit, the inner thigh non-reinforced region, the superior anterior thigh non-reinforced region and the inferior posterior thigh non-reinforced region form together an uninterrupted thigh non-reinforced region, with the only exception of possible discrete stiffening lines.

20. A swim suit according to claim 6, wherein the trunk portion forms:

two upper shoulder openings and an annular shoulder band connected with the shoulder openings, and a back opening, wherein upper ends of the posterior stiffening lines are arranged at and connected to the respective shoulder bands which act as upper anchor points for the stiffening lines.

* * * * *